US009228574B2

(12) United States Patent
Puckett

(10) Patent No.: US 9,228,574 B2
(45) Date of Patent: Jan. 5, 2016

(54) HYDRAULIC RELIEF AND SWITCHING LOGIC FOR CRYOGENIC PUMP SYSTEM

(71) Applicant: CATERPILLAR INC., Peoria, IL (US)

(72) Inventor: Daniel Reese Puckett, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 369 days.

(21) Appl. No.: 13/778,280

(22) Filed: Feb. 27, 2013

(65) Prior Publication Data

US 2014/0241913 A1 Aug. 28, 2014

(51) Int. Cl.
*F04B 9/10* (2006.01)
*F04B 9/103* (2006.01)
*F04B 15/08* (2006.01)

(52) U.S. Cl.
CPC . *F04B 9/10* (2013.01); *F04B 9/103* (2013.01); *F04B 15/08* (2013.01)

(58) Field of Classification Search
CPC ..... F04B 15/08; F04B 9/10; F17C 9/00; F17C 9/02
USPC ..... 417/901
See application file for complete search history.

(56) References Cited

U.S. PATENT DOCUMENTS 4,373,425 A * 2/1983 Moatti ..... 91/227
6,006,525 A * 12/1999 Tyree, Jr. ..... 62/50.6
6,216,456 B1 * 4/2001 Mitchell ..... 60/452
6,898,940 B2 5/2005 Gram et al.
8,065,930 B2 * 11/2011 Sowul et al. ..... 74/473.11
2012/0187218 A1 7/2012 Kim et al.
2012/0204835 A1 8/2012 Kim et al.
2012/0240835 A1 9/2012 Schilling et al.
2012/0255523 A1 10/2012 Kim et al.

FOREIGN PATENT DOCUMENTS

EP 0599599 B1 5/1998
WO WO-2008/037070 A1 4/2008

* cited by examiner

*Primary Examiner* — Nathan J Newhouse
*Assistant Examiner* — Thomas R Cash
(74) *Attorney, Agent, or Firm* — Miller, Matthias & Hull LLP

(57) ABSTRACT

A cryogenic hydraulic reciprocating piston pump includes a casing which defines a piston chamber. The sidewall of the piston chamber includes a retraction spill port as well as a pumping spill port. At the end of a retraction stroke, a retraction spill passageway that extends through the piston becomes aligned with the retraction spill port and fluid is communicated from the pressurized side of the piston to the unpressurized side of the piston to stop the retraction stroke before the piston "bottoms out". Similarly, at the end of a pumping stroke, a pumping spill passageway that extends through the piston becomes aligned with the pumping spill port which provides communication between the pressurized side of the piston and the unpressurized side of the piston thereby stopping movement of the piston before it "bottoms out".

18 Claims, 4 Drawing Sheets

HYDRAULIC RELIEF AND SWITCHING LOGIC FOR CRYOGENIC PUMP SYSTEM

TECHNICAL FIELD

This disclosure relates to hydraulically controlled cryogenic pumps for supplying a cryogenic fluid, such as a cryogenically stored fuel for an internal combustion engine.

BACKGROUND

Natural gas has been used as a fuel for internal combustion engines, primarily because it produces less pollution than diesel or gasoline. Previously, natural gas was introduced into the cylinders through the intake manifold, mixed with the intake air and fed into the cylinders at relatively low pressures. The fuel supply system for a natural gas powered engine is relatively simple. The natural gas is held in and supplied from a tank with a working pressure just above the engine inlet pressure, or from compressed natural gas cylinders through regulators that reduce the pressure to the engine inlet pressure.

Compressed natural gas (CNG) is commonly stored at ambient temperatures at pressures up to 3600 psig (24,925 kPa), and may be unsuitable for many conventional trucks and buses due to the limited operating range and the heavy weight of the storage tanks. On the other hand, liquefied natural gas (LNG) is normally stored at temperatures of between about −240° F. and −175° F. (−150° C. and −115° C.) and at pressures of between about 15 and 200 psig (204 and 1477 kPa) in a cryogenic tank, providing an energy density of about four times that of CNG.

However, better efficiency and emissions can be achieved if the natural gas is injected directly into the engine cylinders under high pressure at the end of the compression stroke of the piston. This requires a fuel supply system that can deliver the natural gas at a pressure of about 3000 psig (20,684 kPa) and above. This makes it impossible to deliver the fuel directly from a conventional LNG tank because it is impractical and uneconomical to build an LNG tank with such a high operating pressure. Equally, it is impossible to deliver the natural gas fuel directly from a conventional CNG tank as the pressure in such a tank is lower than the injection pressure as soon as a small amount of fuel has been withdrawn from the CNG tank. Therefore, in both cases, a booster pump is required to boost the pressure from storage pressure to injection pressure.

Booster pumps in the form of high pressure cryogenic pumps are known, but it has proven difficult to adapt these pumps to the size and demand of a vehicle pump. In general, cryogenic pumps should have a positive suction pressure. It has therefore been common practice to place the pump directly in the LNG so that the head of the LNG will supply the desired pressure. The problem with this approach is that it introduces a large heat leak into the LNG storage tank. Some designs place the pump outside the storage tank and have reduced the required suction pressure by using a large first stage suction chamber. The excess LNG which is drawn into such a chamber is returned to the LNG tank and again, additional heat is introduced into the LNG, which is undesirable.

Conventional cryogenic pumps are typically centrifugal pumps, which are placed either in the liquid inside the storage tank, or below the storage tank in a separate chamber with a large suction line leading from the tank, with both the pump and suction line being well insulated. Because a cryogenic liquid is at its boiling temperature when stored, heat is leaked into the suction line and a reduction in pressure will cause vapor to be formed. Thus, if the centrifugal pump is placed outside the tank, vapor is formed and the vapor will cause the pump to cavitate and the flow to stop. Consequently, cryogenic pumps of the centrifugal type require a positive feed pressure to prevent or reduce the tendency to cavitation of the pump. Also, centrifugal pumps cannot easily generate high discharge pressures to properly inject fuel directly into the engine cylinder.

Reciprocating piston pumps have been used for pumping LNG, but such pumps also require a positive feed pressure to reduce efficiency losses that can arise with a relatively high speed piston pump. Such pumps may have a single chamber in which an induction stroke is followed by a discharge stroke, and thus the inlet flow will be stopped half of the time while the piston executes the discharge stroke. U.S. Pat. No. 6,898,940 discloses a dual chamber reciprocating pump that avoids this issue.

The reciprocating piston cryogenic pump of U.S. Pat. No. 6,898,940 is hydraulically actuated. During the compression phase, there is a desire to keep the piston from bottoming out and there is a need to know when to begin the retraction of the piston. One conventional solution is to sense the increase in the hydraulic system pressure as a signal that the end of the compression stroke has been reached and that the retraction stroke should be commenced. However, this solution may still result in bottoming out of the piston at high hydraulic pressures. Another approach uses an integration of the estimated piston velocity to indicate when the end of the compression stroke has been reached. However, this approach is not optimum if there are errors in volumetric efficiency (i.e., leakage) or errors in the hydraulic pressure, gas pressure or consumption measurements. Yet another approach involves placing a position sensor to indicate the end of the compression stroke. However, this design is not robust and will not prevent bottoming out of the piston if there is a failure of the position sensor.

Thus, improved hydraulically activated cryogenic pumps for delivering LNG to internal combustion engines are needed.

SUMMARY

In one aspect, a pumping system is disclosed. The pumping system may include a casing that may include a retraction end and a pumping end with a sidewall disposed between the retraction and pumping ends. The retraction and pumping ends and the sidewall may define a piston chamber. The piston chamber may accommodate a piston. The sidewall may include a retraction spill port that extends into the sidewall and a pumping spill port that also extends into the sidewall. The casing may include a first hydraulic passageway disposed between a retraction spill port and the retraction end of the casing and that is in communication with a hydraulic fluid reservoir. The casing may further include a second hydraulic passageway disposed between the pumping spill port and the pumping end of the casing and that is in communication with the hydraulic fluid reservoir. The piston may include a retraction spill passage that provides communication from a pumping portion of the piston chamber, that is disposed between the piston and the pumping end of the casing, and the retraction spill port. The piston may further include a pumping spill passage that provides communication from a retraction portion of the piston chamber, that is disposed between the piston and the retraction end of the casing, and the pumping spill port.

In yet another aspect, a hydraulic reciprocating piston pump is disclosed that may include a casing that may include a retraction end and a pumping end with a sidewall disposed therebetween. The retraction and pumping ends and the sidewall may define a piston chamber. The piston chamber may accommodate a piston. The sidewall may include a retraction spill port that extends into the sidewall and a pumping spill port that also extends into the sidewall. The casing may include a first hydraulic passageway disposed between the retraction spill port and the retraction end of the casing. The casing may also include a second hydraulic passageway disposed between the pumping spill port and the pumping end of the casing. The piston may include retraction spill passage that provides communication from a pumping portion of the piston chamber, that is disposed between the piston and the pumping end of the casing, and the retraction spill port. The piston may also include a pumping spill passage that provides communication from a retraction portion of the piston chamber, that is disposed between the piston and the retraction end of the casing, and the pumping spill port.

In yet another aspect, a machine is disclosed which may include an engine coupled to a pump. The pump may be in communication with a hydraulic fluid reservoir. The pump and hydraulic fluid reservoir may be in communication with a direction control valve. The pump may include a casing that may include a retraction end and a pumping end with a sidewall disposed therebetween. The retraction and pumping ends and the sidewall may define a piston chamber. The piston chamber may accommodate a piston that is connected to a rod that sealably passes through the pumping end of the casing and that is slidably received in a rod chamber. The rod chamber may include an outlet that is in communication with a fuel line that is in communication with the engine. The sidewall of the casing may include a retraction spill port that extends into the sidewall and a pumping spill port that also extends into the sidewall. The casing may include a first hydraulic passageway disposed between the retraction spill port and the retraction end of the casing and that is in communication with the directional control valve. The casing may also include a second hydraulic passageway disposed between the pumping spill port and the pumping end of the casing and that is in communication with the directional control valve. The piston may include a retraction spill passage that provides communication from a pumping portion of the piston chamber, that is disposed between the piston and the pumping end of the casing, and the retraction spill port. The piston may also include a pumping spill passage that provides communication from a retraction portion of the piston chamber, that is disposed between the piston and the retraction end of the casing, and the pumping spill port.

DESCRIPTION

Figure 1:
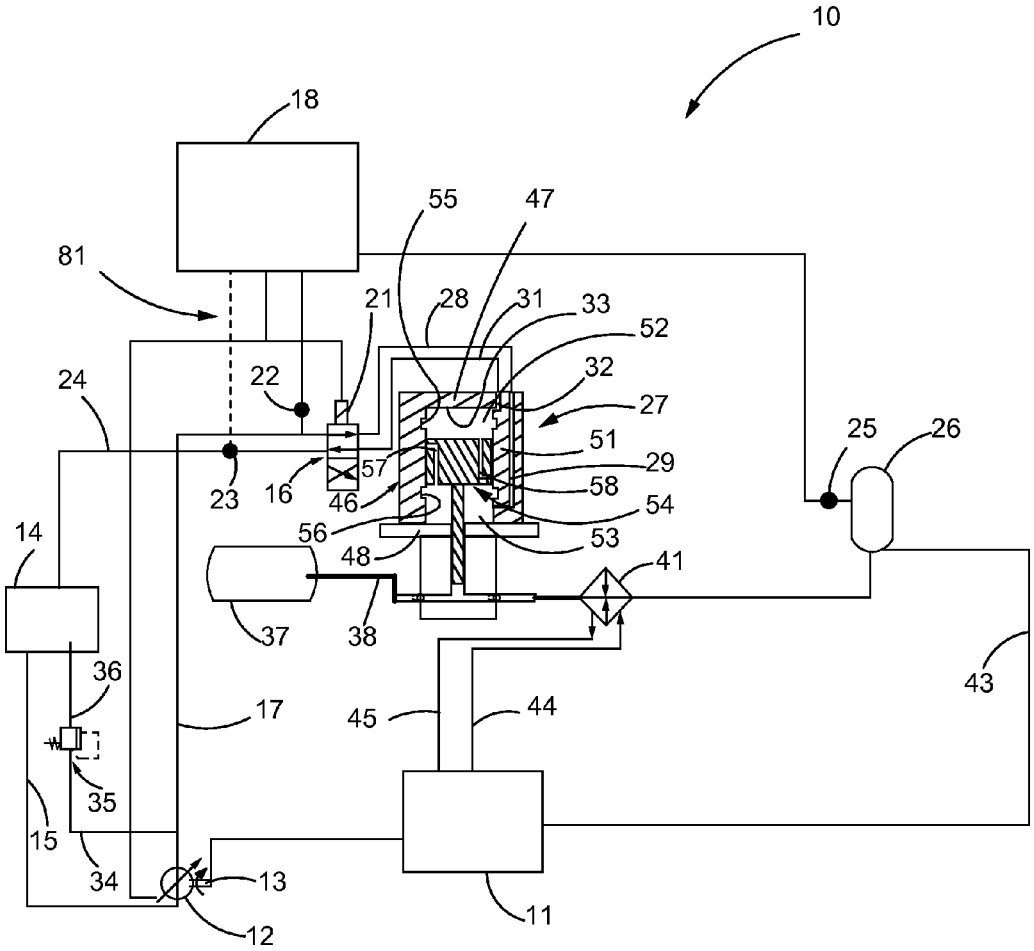
FIG. 1 is a schematic illustration of a disclosed pump and a disclosed pumping system as incorporated into a disclosed machine.

FIG. 1 partially illustrates a machine 10 that may include an engine 11 that may be coupled to a hydraulic pump 12 via a drive shaft 13 or other suitable coupling element. The hydraulic pump 12 receives hydraulic fluid from the hydraulic fluid reservoir 14 via the conduit 15. The pump 12 may then deliver fluid to a directional control valve 16 via the conduit 17. A controller 18 may be utilized to control the pump 12 and the actuator 21 of the directional control valve 16. The controller 18 may also be linked to one or more pressure sensors including the pressure sensor 22 that is in communication with the conduit 17. The controller 18 may also be linked to the pressure sensor 23 which is in communication with the return conduit 24. The return conduit 24 provides communication between the directional control valve 16 and the hydraulic reservoir 14. The controller 18 may also be linked to the pressure sensor 25 that may measure the pressure within the accumulator 26.

The directional control valve 16 controls the flow of hydraulic fluid to and from the reciprocating piston pump 27. As shown in FIG. 1, the pump 27 is in the middle of a retraction stroke as the pump 12 delivers fluid through the conduit 17, through the directional control valve 16 and to the conduit 28 which leads to the hydraulic passageway 29. When shifted upward in the orientation of FIG. 1, the directional control valve 16 connects the conduit 17 with the conduit 31 which leads to the hydraulic passageway 32. When pressure is being delivered through the conduit 31 and through the hydraulic passageway 32 and into the piston chamber 33, pressure in the conduit 17 may increase thereby causing a pressure increase in the connecting conduit 34 which causes the normally closed pressure release valve 35 to open thereby providing communication between the hydraulic reservoir 14 and the conduit 17 via the conduits 36, 34 as shown in FIG. 1.

The pump 27 may be used to deliver a cryogenic fluid, such as LNG from the tank 37 through the fuel line 38 and vaporizer 41 to the accumulator 26. As the accumulator 26 is charged and the pressure reaches an appropriate input pressure for the engine 11, LNG flows through the input line 43 to the engine 11. Energy may be supplied to the vaporizer 41 by engine coolant that flows from and to the engine 11 via the conduits 44, 45. As will be shown below, only one of the pressure sensors 22, 23 is necessary to provide the information needed to effectively shift the directional control valve 16.

Still referring to FIG. 1 as well as FIGS. 2-7, the pump 27 may include a casing 46 that may include a retraction end 47 and a pumping end 48. A sidewall 51 may be disposed between the retraction end 47 and pumping end 48. The retraction end 47, pumping end 48 and sidewall 51 may define the piston chamber 33 which, for descriptive purposes, may include a retraction portion 52 and a pumping portion 53.

Figure 5:
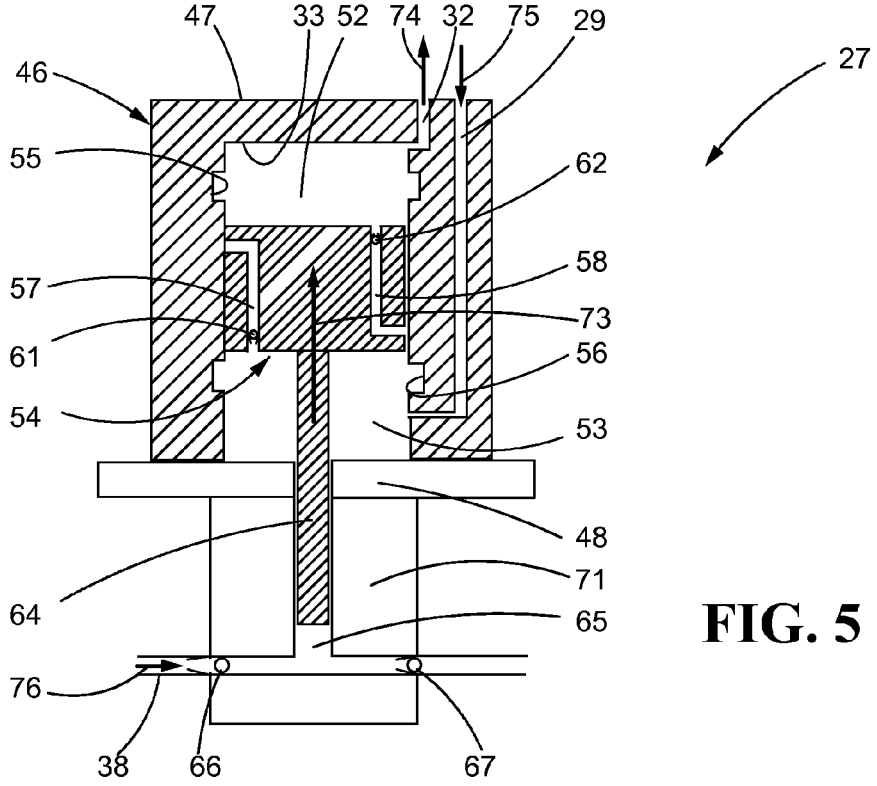
FIG. 5 is a sectional view of the pump shown in FIGS. 2-4 in the middle of the retraction stroke.
Figure 6:
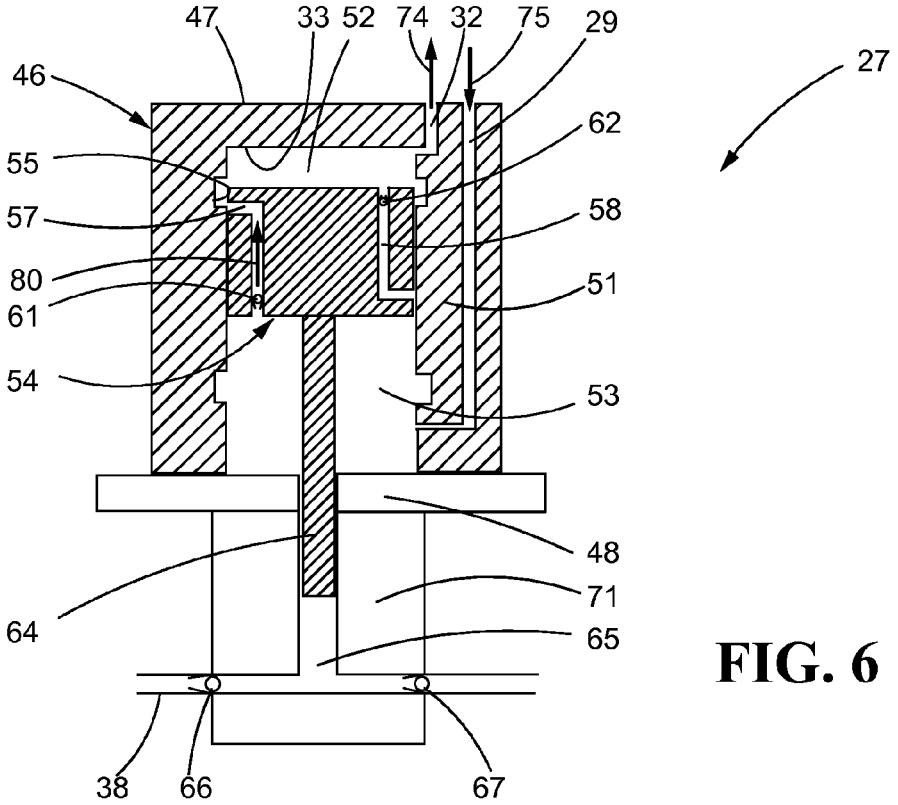
FIG. 6 is a sectional view of the pump shown in FIGS. 2-5 at the end of the retraction stroke.
Figure 7:
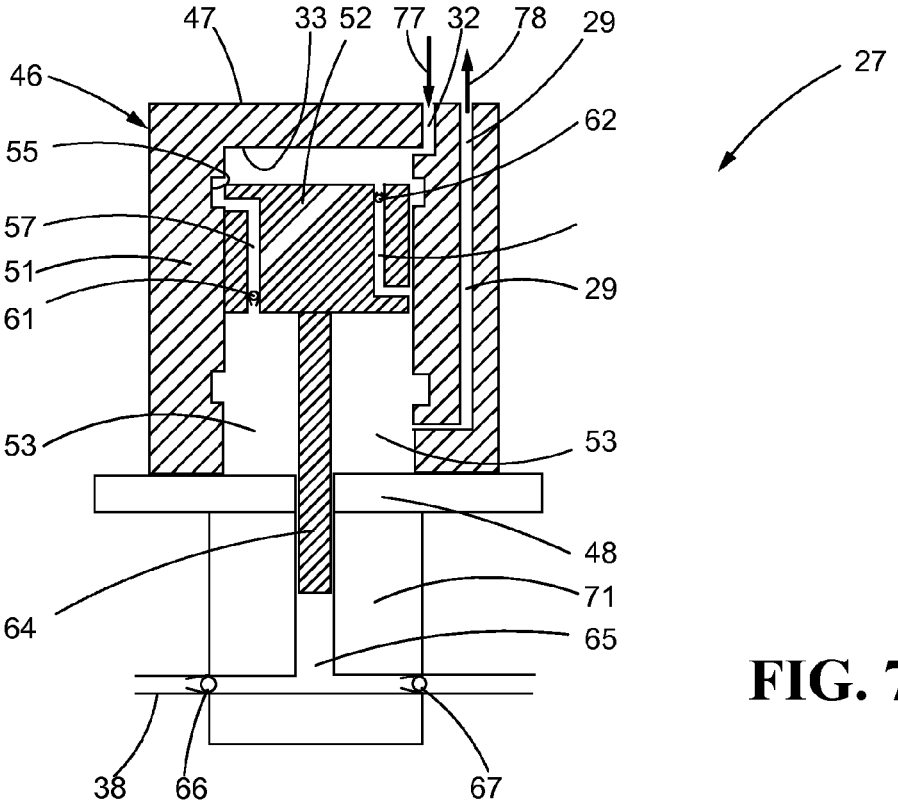
FIG. 7 is a sectional view of the pump shown in FIGS. 2-6 at the start of the pumping stroke.

The piston chamber 33 accommodates the piston 54. The piston chamber 33 may also include a retraction spill port 55 that may be annular as shown in FIGS. 1-7 and a pumping spill port 56 that may also be annular as shown. Further, the piston 54 may include two spill passages including a retraction spill passage 57 that provides communication between the pumping portion 53 of the piston chamber 33 and the retraction spill port 55. Further, the piston 54 may include a pumping spill passage 58 that may provide communication between the retraction portion 52 of the piston chamber 33 and the pumping spill port 56. As best seen in FIGS. 2-7, the retraction spill passage 57 may include a check valve 61 so that fluid may flow in only one direction through the retraction spill passage 57, that is from the pumping portion 53 of the piston chamber 33 to the retraction spill port 55 as best seen in FIG. 6, which, as explained below, presents the end of a retraction stroke. Similarly, the pumping spill passage 58 may also include a check valve 62 that permits flow only from the retraction portion 52 of the piston chamber 33 to the pumping spill port 56, which signals the end of a pumping stroke as shown in FIG. 3.

Figure 2:
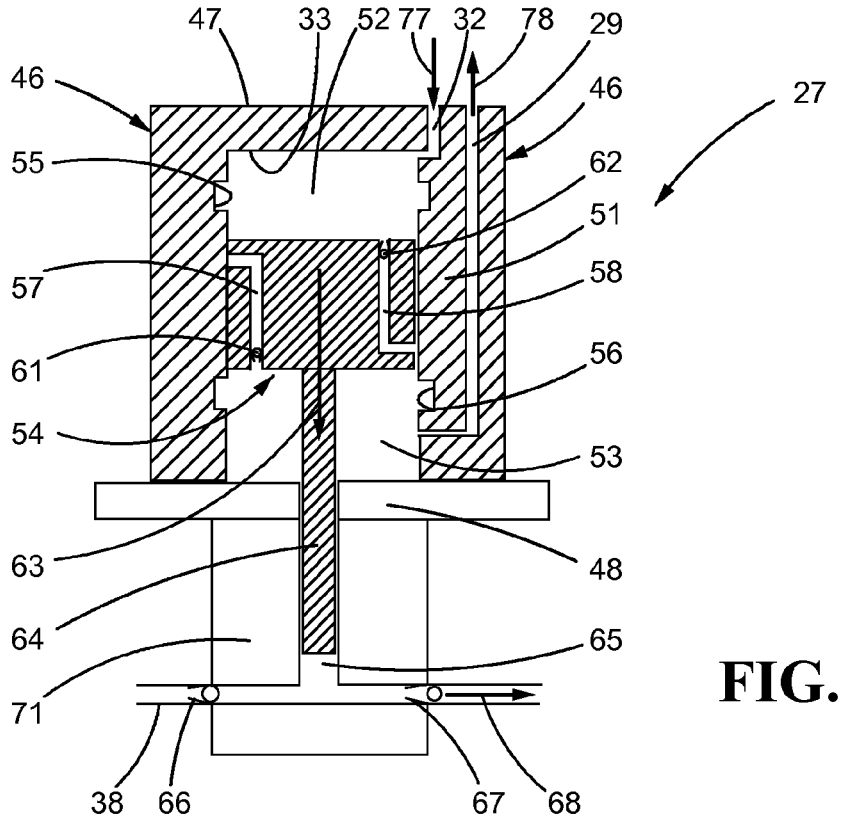
FIG. 2 is a sectional view of a disclosed pump in the middle of a-pumping stroke.
Figure 3:
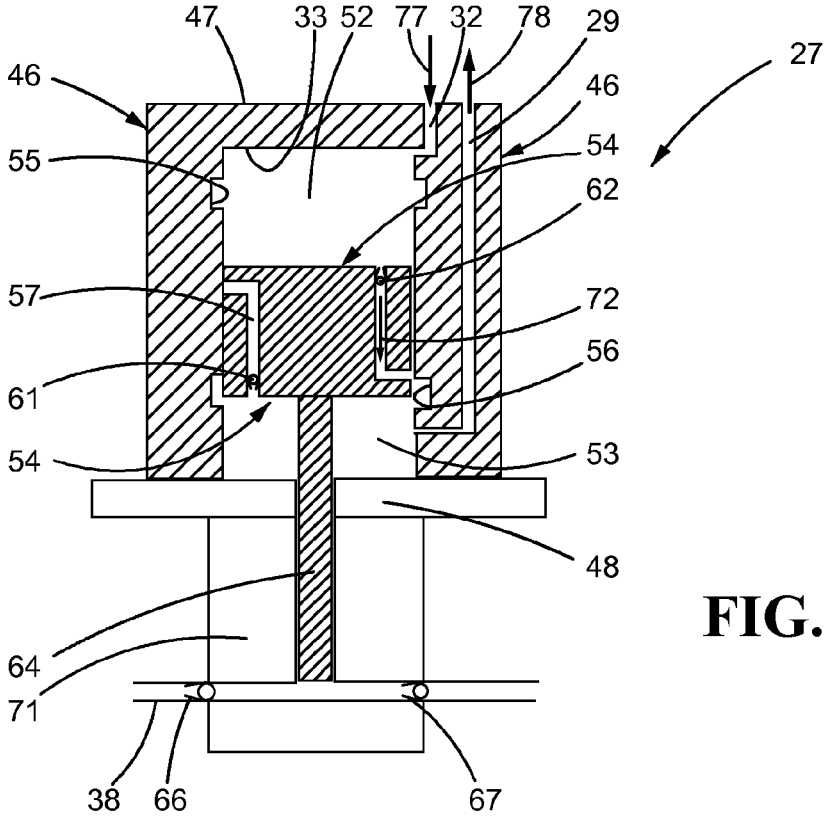
FIG. 3 is a sectional view of the pump shown in FIG. 2 at the end of a pumping stroke.

Turning to the sequence illustrated in FIGS. 2-7, FIG. 2 illustrates the piston 58 in the middle of the pumping stroke as the piston 54 is moving in the direction of the arrow 63 or downward in the orientation of FIG. 2 towards the pumping portion 53 of the piston chamber 33. The piston 58 is sliding along the sidewall 51 between the retraction spill port 55 and the pumping spill port 56. The piston 54 may be connected to a rod 64 that passes through the pumping end 48 of the casing 46 and into a rod chamber 65. Movement of the rod 64 through the rod chamber 65 applies pressure to the fuel line 38 which may include check valves 66, 67 to ensure flow of the cryogenic fluid or LNG in the direction of the arrow 68. During the pumping stroke, the directional control valve 65 is shifted upward from its position shown in FIG. 1 so that the pump 12 and conduit 17 are in communication with the conduit 31 and hydraulic passageway 32 thereby providing pressurized fluid to the retraction portion 52 of the piston chamber 33 as indicated by the arrow 77. The hydraulic passageway 29 serves as a return line as fluid flows from the pumping portion 53 of the piston chamber 33 through the hydraulic passageway 29 in the direction of the arrow 78, through the conduit 28 to the return conduit 24 before entering the hydraulic reservoir 14. It will also be noted that the rod 64 and rod chamber 65 may be disposed within a block 71 through which the fuel line 38 passes.

Turning to FIG. 3, the piston 54 is shown at the end of its pumping stroke as the pumping spill passageway 58 is in communication with the pumping spill port 56 thereby causing fluid to flow from the retraction portion 52 of the piston chamber 33 past the check valve 62 and in the direction of the arrow 72. The communication between the retraction portion 52 of the piston chamber 33 and the pumping portion 53 of the piston chamber 33 reduces the pressure in the retraction portion 52 of the piston chamber 33 thereby causing the piston 54 and rod 64 to slow down and stop its movement in the direction of the arrow 63 shown in FIG. 2. Thus, FIG. 3 illustrates the end of a pumping stroke. In an embodiment, the reduction in pressure in the retraction portion 52 of the piston chamber 33 may be detected by the pressure sensor 22 and communicated to the controller 18. The controller 18 may then switch the directional control valve 16 to the retraction position shown in FIG. 1 (the pumping position of the directional control valve 16 is not shown in FIG. 1).

Figure 4:
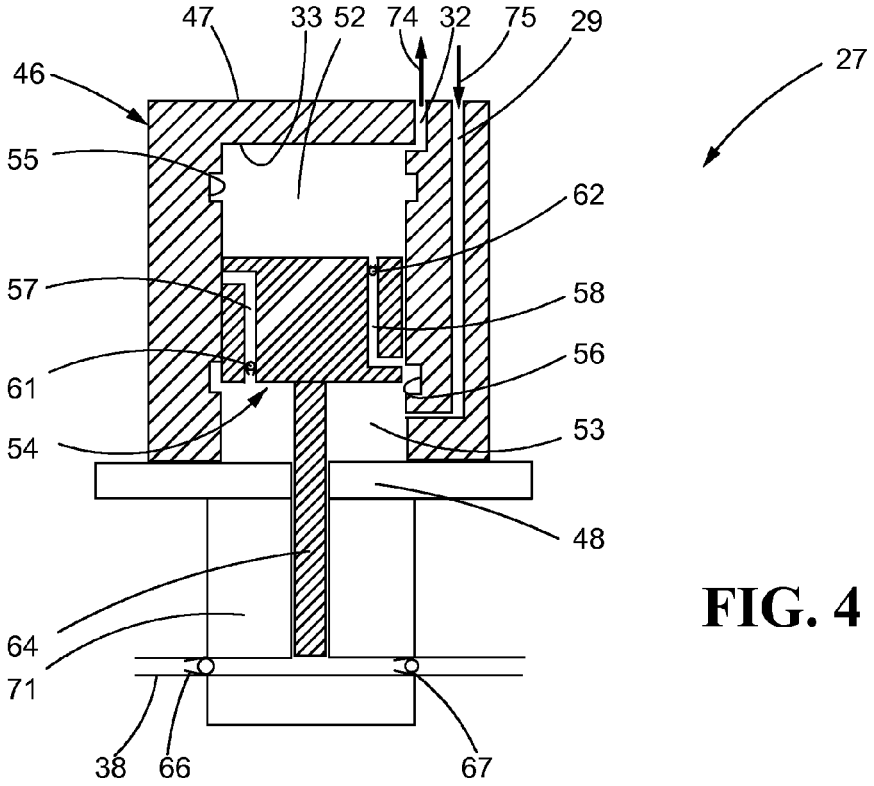
FIG. 4 is a sectional view of the pump shown in FIGS. 2-3 at the start of the retraction stroke.

In contrast, FIG. 4 illustrates the pump 27 at the beginning of its retraction stroke. The controller has switched the directional control valve 16 to the position shown in FIG. 1 and fluid is being delivered through the conduit 28 (FIG. 1) through the hydraulic passageway 29 in the direction of the arrow 75 to the pumping portion 53 of the piston chamber 33. Thus, pressure is building within the pumping portion 53 of the piston chamber 33 which, as shown in FIG. 5, results in the rod 64 and piston 54 moving in the direction of the arrow 73. As shown in FIGS. 4-5, the check valve 62 prevents fluid from flowing from the pumping portion 53 of the chamber 33 and through the pumping spill passageway 58 and into the retraction portion 52 of the chamber 33. Thus, as shown in FIG. 5, with the piston 54 and rod 64 moving in the direction of the arrow 73, the pump 27 is in the middle of a retraction stroke. During a pumping stroke, fluid is exiting the hydraulic passageway 32 in the direction of the arrow 74 and fluid is being delivered to the hydraulic passageway 29 in the direction of the arrow 75. Thus, the pumping portion 53 of the chamber 33 is pressurized which causes the piston 54 to move in the direction of the arrow 73. Further, movement of the rod 64 within the rod chamber 65 and away from the fuel line 38 provides suction in the fuel line 38 thereby causing the LNG to continue to flow in the direction of the arrow 76 past the check valves 66, 67.

Turning to FIG. 6, the piston 54 has reached the end of its retraction stroke as the retraction spill passageway 57 is in communication with the retraction spill port 55 thereby providing communication between the pumping portion 53 of the chamber 33 and the retraction portion 52 of the chamber 33. As a result, fluid flows in the direction of the arrow 80 and the pressure in the pumping portion 53 of the chamber 33 decreases and this decrease in pressure is sensed by the pressure sensor 22 and communicated to the controller 18. With the piston 54 at the end of its retraction stroke, the controller 18 sends a signal to the actuator 21 to shift the directional control valve 16 back to the pumping position (not shown in FIG. 1) so that hydraulic fluid flows into the retraction portion 52 of the chamber 33 in the direction of the arrow 77 and fluid begins to exit the pumping portion 53 of the chamber 33 through the hydraulic passageway 29 in the direction of the arrow 78.

Thus, as shown in FIGS. 2-7, the piston 54 never "bottoms out" or reaches the retraction end 47 of the casing 46 or the pumping end 48 of the casing 46. The combination of the retraction spill port 55, retraction spill passageway 57, pumping spill port 56 and pumping spill passageway 58 prevents these occurrences. Thus, at the end of the pumping stroke as shown in FIG. 3, the reduction and pressure in the retraction portion 52 of the chamber 33 may be sensed by the pressure sensor 22. Use of the pressure sensor 22 in the conduit 17 may be preferable to using the pressure sensor 23 in the return conduit 24 at high hydraulic pressures. Further, the pressure sensor 22 is located outside of the pump 27 and therefore no position sensor is required to be placed within the piston chamber 33. Locating the sensors 22 or 23 outside of the piston chamber 33 provides for a more robust and more reliable design. Similarly, at the end of a retraction stroke as shown in FIG. 6, the reduction in pressure in the pumping portion 53 of the piston chamber 33 may be detected by the sensor 22 and no position sensor within the piston chamber 33 is necessary.

INDUSTRIAL APPLICABILITY

A cryogenic pump 27 is disclosed that may be part of a machine 10 and an overall pumping system 81 which prevents the piston 54 from bottoming out at either the retraction end 47 of the pump casing 46 or at the pumping end 48 of the pump casing 46. Further, position sensors within the piston chamber 33 are not required and, the use of the retraction spill port 55, retraction spill passageway 57, pumping spill port 56 and pumping spill passageway 58 enables a reduction in pressure to be detected by the sensor 22 and such a detected reduction in pressure causes the controller 18 to shift the directional control valve 16 accordingly. Thus, an improved cryogenic pump 27, an improved cryogenic pumping system 81 and an improved machine 10 incorporating the same are disclosed.

The invention claimed is:

1. A pumping system comprising:

a casing including a retraction end and a pumping end with a sidewall disposed therebetween, the retraction and pumping ends and the sidewall defining a piston chamber, the piston chamber accommodating a piston reciprocatable within the chamber between a retraction portion disposed between the piston and the retraction end of the casing and a pumping portion disposed between the piston and the pumping end of the casing;

the sidewall including a retraction spill port that extends into the sidewall annularly about the retraction portion of the piston chamber and a pumping spill port that extends into the sidewall annularly about the pumping portion of the piston chamber;

the casing including a first hydraulic passageway disposed between the retraction spill port and the retraction end of the casing and that is in communication with a hydraulic fluid reservoir separate and apart from the casing, the casing sidewall including a second hydraulic passageway disposed between the pumping spill port and the pumping end of the casing and that is in communication with the hydraulic fluid reservoir;

the piston including a retraction spill passage configured to cooperate with the retraction spill port to provide communication from the pumping portion of the piston chamber and the retraction spill port when the piston is in a first position, the piston including a pumping spill passage configured to cooperate with the pumping spill port to provide communication from the retraction portion of the piston chamber and the pumping spill port when the piston is in a second position.

2. The pumping system of claim 1 further including a directional control valve in communication with the first and second hydraulic passageways, the directional control valve providing selective communication between the first and second hydraulic passageways and the hydraulic fluid reservoir.

3. The pumping system of claim 1 further including a directional control valve in communication with the first and second hydraulic passageways, the directional control valve providing selective communication between the first and second hydraulic passageways and a return line connected to the hydraulic fluid reservoir and an input line connected to a pump that is in communication with the hydraulic fluid reservoir.

4. The pumping system of claim 3 further including a pressure sensor in communication with the return line or the input line, the pressure sensor being linked to a controller, the controller being linked to an actuator of the directional control valve.

5. The pumping system of claim 4 wherein the controller is also linked to the pump.

6. The pumping system of claim 1 wherein the retraction spill passage includes a check valve that permits communication from the pumping portion of the piston chamber, the pumping spill passage includes a check valve that provides communication from the retraction portion of the piston chamber and the pumping spill port.

7. The pumping system of claim 1 wherein the piston is connected to a rod that sealably passes through the pumping end of the casing and that is slidably received in a rod chamber, the rod chamber including an outlet.

8. The pumping system of claim 1 wherein the retraction and pumping spill ports are annular.

9. The pumping system of claim 7 wherein the outlet is in communication with a fuel line.

10. A hydraulic reciprocating piston pump comprising:

a casing including a retraction end and a pumping end with a sidewall disposed therebetween, the retraction and pumping ends and the sidewall defining a piston chamber, the piston chamber accommodating a piston reciprocatable within the chamber between a retraction portion disposed between the piston and the retraction end of the casing and a pumping portion disposed between the piston and the pumping end of the casing;

the sidewall including a retraction spill port that extends into the sidewall annularly about the retraction portion of the piston chamber and a pumping spill port that extends into the sidewall annularly about the pumping portion of the piston chamber;

the casing including a first hydraulic passageway disposed between the retraction spill port and the retraction end of the casing, the casing sidewall including a second hydraulic passageway disposed between the pumping spill port and the pumping end of the casing;

the piston including a retraction spill passage configured to cooperate with the retraction spill port to provide communication from the pumping portion of the piston chamber and the retraction spill port when the piston is in a first position, the piston including a pumping spill passage configured to cooperate with the pumping spill port to provide communication from the retraction portion of the piston chamber and the pumping spill port when the piston is in a second position.

11. The pump of claim 10 wherein the retraction spill passage includes a check valve that permits communication from the pumping portion of the piston chamber and the retraction spill port, the pumping spill passage includes a check valve that provides communication from the retraction portion of the piston chamber and the pumping spill port.

12. The pump of claim 10 wherein the piston is connected to a rod that sealably passes through the pumping end of the casing and that is slidably received in a rod chamber, the rod chamber including an outlet.

13. A machine comprising:

an engine coupled to a pump, the pump in communication with a hydraulic fluid reservoir, the pump and hydraulic fluid reservoir in communication with a directional control valve;

the pump including a casing including a retraction end and a pumping end with a sidewall disposed therebetween, the retraction and pumping ends and the sidewall defining a piston chamber, the piston chamber accommodating a piston reciprocatable within the chamber between a retraction portion disposed between the piston and the retraction end of the casing and a pumping portion disposed between the piston and the pumping end of the casing and that is connected to a rod that sealably passes through the pumping end of the casing and that is slidably received in a rod chamber, the rod chamber including an outlet that is in communication with a fuel line that is in communication with the engine;

the sidewall of the casing including a retraction spill port that extends into the sidewall annularly about the refraction portion of the piston chamber and a pumping spill port that extends into the sidewall annularly about the pumping portion of the piston chamber;

the casing including a first hydraulic passageway disposed between the retraction spill port and the retraction end of the casing and that is in communication with the directional control valve, the casing sidewall including a second hydraulic passageway disposed between the pumping spill port and the pumping end of the casing and that is in communication with the directional control valve;

the piston including a retraction spill passage configured to cooperate with the retraction spill port to provide communication from the pumping portion of the piston chamber and the retraction spill port when the piston is in a first position, the piston including a pumping spill passage configured to cooperate with the pumping spill port to provide communication from the retraction portion of the piston chamber and the pumping spill port when the piston is in a second position.

14. The machine of claim 13 wherein the directional control valve providing selective communication between the first and second hydraulic passageways and the hydraulic fluid reservoir.

15. The machine of claim 13 wherein the directional control valve providing selective communication between the first and second hydraulic passageways and a return line connected to the hydraulic fluid reservoir and an input line connected to a pump that is in communication with the hydraulic fluid reservoir.

16. The machine of claim 15 further including a pressure sensor in communication with the return line or the input line, the pressure sensor being linked to a controller, the controller being linked to an actuator of the directional control valve.

17. The machine of claim 16 wherein the controller is also linked to the pump.

18. The machine of claim 13 wherein the retraction spill passage includes a check valve that permits communication from the pumping portion of the piston chamber and the retraction spill port, the pumping spill passage includes a check valve that provides communication from the retraction portion of the piston chamber and the pumping spill port.

* * * * *